US005863126A

United States Patent [19]

Guild

[11] Patent Number: 5,863,126

[45] Date of Patent: Jan. 26, 1999

[54] FLUID MIXING AND DISPENSING SYSTEM FOR THE RAPID MIXING OF A PRESTORED SUBSTANCE WITH A FLUID AND THE DISPENSING THEREOF

[76] Inventor: William Guild, 1400 Westford St., Carlilse, Mass. 01741

[21] Appl. No.: 844,100

[22] Filed: Apr. 18, 1997

Related U.S. Application Data

[62] Division of Ser. No. 440,499, Jun. 28, 1995, Pat. No. 5,634,714.

[51] Int. Cl.[6] ..... A61J 9/00; B65D 25/08

[52] U.S. Cl. ..... 366/130; 206/220; 206/221; 215/11.1; 215/DIG. 8

[58] Field of Search ..... 366/130, 189, 366/347, 349; 206/219, 220, 221; 215/DIG. 7, DIG. 8, 11.1, 11.6

[56] References Cited

U.S. PATENT DOCUMENTS

| | | | |
|---|---|---|---|
| 3,477,431 | 11/1969 | Walecka | 206/221 X |
| 3,539,794 | 11/1970 | Rauhut et al. | 206/219 |
| 3,651,990 | 3/1972 | Cernei | 206/221 X |
| 3,733,179 | 5/1973 | Guehler | 422/72 X |
| 4,408,690 | 10/1983 | Ferrero | 206/219 X |
| 5,076,425 | 12/1991 | Plone | 206/221 X |
| 5,152,965 | 10/1992 | Fisk et al. | 206/219 X |
| 5,183,183 | 2/1993 | Hernandez | 206/221 X |
| 5,417,321 | 5/1995 | Halm | 215/DIG. 8 X |

*Primary Examiner*—Charles E. Cooley
*Attorney, Agent, or Firm*—Robert K. Tendler

[57] ABSTRACT

A fluid mixing system is provided to permit rapid mixing of a prestored powdered substance such as powdered milk with a liquid in which, in one embodiment, baby bottles are stacked one atop the other in fluid communication, with an internally carried stemmed disk preventing powdered contents of the upper bottle from entering the liquid carried by the lower bottle until the stemmed disk is dislodged from the aperture between the bottles, the stemmed disk falling into the lower bottle such that the mixing can occur without opening or separating the two bottles. The invention thus allows the separate storage of two pre-measured fluent materials within the same container, and to facilitate the mixing and dispensing of those materials at a later time without opening the container. The benefits of this are that the user can prepare in advance mixtures of materials which, if stored in a combined state, will sour, harden, or otherwise become unusable without mixing the two ingredients until the time of use. Using this device, the user can pre-measure ingredients and assemble the containers at a convenient time. The resulting assemblies can be stored and transported easily. When needed, the user can mix the prepared contents in a few seconds with only one hand, with the contents being prevented from spilling during storage, transportation, mixing, and use.

2 Claims, 4 Drawing Sheets

FLUID MIXING AND DISPENSING SYSTEM FOR THE RAPID MIXING OF A PRESTORED SUBSTANCE WITH A FLUID AND THE DISPENSING THEREOF

RELATED APPLICATIONS

This application is a divisional application of U.S. patent application Ser. No. 08/440,499, filed Jun. 28, 1995, now U.S. Pat. No. 5,634,714.

FIELD OF THE INVENTION

This invention pertains to containers for the storage and mixture of ingredients and more particularly to application in any application in which two ingredients are mixed prior to use and where it is desirable for the two ingredients to be stored separately until mixing just prior to use.

Examples of such fields are: powdered baby formulas and dietary supplements which will spoil at room temperatures after being mixed with milk or water; and paints and adhesives which will dry or harden after the ingredients are mixed.

BACKGROUND OF THE INVENTION

Baby bottles are used for feeding liquids such as milk or infant formula to babies. Powdered infant formulas must be measured and mixed with water prior to feeding via a baby bottle. Several problems or difficulties accompany the use of powdered formulas. It is difficult to pack and carry the powdered formula, water, and bottles when feeding away from home and the feeding schedules of infants often require parents to feed while away from home. Measuring and mixing formula is time consuming and forces infants to wait for a feeding. This is particularly problematic at night. Powdered formulas can be premixed, but the resulting liquid formula must be refrigerated which is difficult while traveling and adds the problem of warming the formula to feeding temperature.

Several patents exist for containers which store two materials separately and permit intra-container mixing prior to use. These designs all require that the package be loaded at the time of manufacture and the containers are not reusable. The two closest examples of such a container intended for use in feeding babies are a Container Such as a Nursing Container, Having Formed Enclosure Chamber, U.S. Pat. No. 4,629,080, and a Two Compartment Bag with Incorporated Nipple. Another example of a similar concept is a Nursing Bottle Accessory Having Means for the Introduction of a Solid or Liquid, U.S. Pat. No. 4,821,895. In the latter example, the second ingredient is not stored together with the first as a single unit. Moreover, the second ingredient is not pre-measured for controlled dosage, and the second ingredient must be prepared and introduced separately at the time of feeding.

SUMMARY OF THE INVENTION

The invention is a primary container with a removable stemmed plug in the form of a disk which attaches to an annular slot in the aperture between the primary and secondary container. One ingredient is stored in each container and the two containers are connected with the stemmed plug forming a partition between the two containers. At the time of use, the stem permits opening of the plug without opening or separating the two containers. Opening the plug allows the two ingredients to mix for use.

It will be appreciated that the above apparatus allows the separate storage of two pre-measured fluent materials within the same container, and to facilitate the mixing and dispensing of those materials at a later time without opening the container. The benefits of this are that the user can prepare in advance mixtures of materials which, if stored in a combined state, will sour, harden, or otherwise become unusable without mixing the two ingredients until the time of use. Using this device, the user can pre-measure ingredients and assemble the containers at a convenient time. The resulting assemblies can be stored and transported easily. When needed, the user can mix the prepared contents in a few seconds with only one hand. The contents are prevented from spilling during storage, transportation, mixing, and use. The stemmed plug assists in mixing the two materials. The plug floats to keep it clear of the dispensing opening when the container is inverted.

In one embodiment, a baby bottle is provided for the rapid mixing of a prestored substance with a fluid which involves the use of primary and secondary containers in fluid communication, with the containers having walls and mating orifices and with the primary container adapted to contain the prestored substance. The secondary container is adapted to contain the above mentioned fluid.

Means including an apertured nipple of flexible material is provided at the top of the apertured container, with the nipple being connected with the interior of the primary container for dispensing fluid after mixing. The nipple has a longitudinal extent so as to form a chamber having a vertically extending portion. A stemmed disk is provided having a stem with a distal end opposite the end with the disk, with the disk adapted to seal the orifice associated with the primary container. The distal end of the stem is positioned proximate the tip of the nipple, with the stem of the stemmed disk projecting into the primary container along the longitudinal centerline of the container into the vertically extending portion of the nipple. The portion of the stem positioned within the vertically extending portion of the nipple is spaced from the nipple to define a free annular portion therebetween.

The disk has an outer periphery disposed in the orifice associated with the primary container, with the containers being demountable to permit refilling and reuse as well as permitting reuse of the stemmed disk.

Means are provided for sealing the disk in the orifice in a snap fit, with the orifice associated with the primary container having an annular member projecting inwardly from an interior wall of the primary container.

The result is that the disk is retained in sealed communication with the annular member in a snap fit such that movement of the stem causes the disk to move with respect to the annular member, at which point the disk becomes unsnapped to permit mixing.

In serving this purpose the design incorporates several advantageous features. It is comprised of only a few parts. The parts are of inexpensive material and are simple to manufacture. The device can be assembled and loaded in two ways according to the preference of the user. Both methods of assembly and use are simple. The parts can be cleaned and sterilized easily and thoroughly as there are no crevices or parts which remain interlocked during cleaning. The device can be reused any number of times.

In summary, a fluid mixing system is provided to permit rapid mixing of a prestored powdered substance such as powdered milk with a liquid in which, in one embodiment, baby bottles are stacked one atop the other in fluid communication, with an internally carried stemmed disk preventing powdered contents of the upper bottle from entering the liquid carried by the lower bottle until the stemmed disk is dislodged from the aperture between the bottles, the stemmed disk falling into the lower bottle such that the mixing can occur without opening or separating the two bottles. The invention thus allows the separate storage of two pre-measured fluent materials within the same container, and to facilitate the mixing and dispensing of those materials at a later time without opening the container.

The benefits of this are that the user can prepare in advance mixtures of materials which, if stored in a combined state, will sour, harden, or otherwise become unusable without mixing the two ingredients until the time of use. Using this device, the user can pre-measure ingredients and assemble the containers at a convenient time. The resulting assemblies can be stored and transported easily. When needed, the user can mix the prepared contents in a few seconds with only one hand, with the contents being prevented from spilling during storage, transportation, mixing, and use.

BRIEF DESCRIPTION OF THE DRAWINGS

These and other features of the Subject Invention will be better understood taken in conjunction with the Detailed Description in conjunction with the Drawings of which.

DETAILED DESCRIPTION OF THE DRAWINGS

Figure 1:
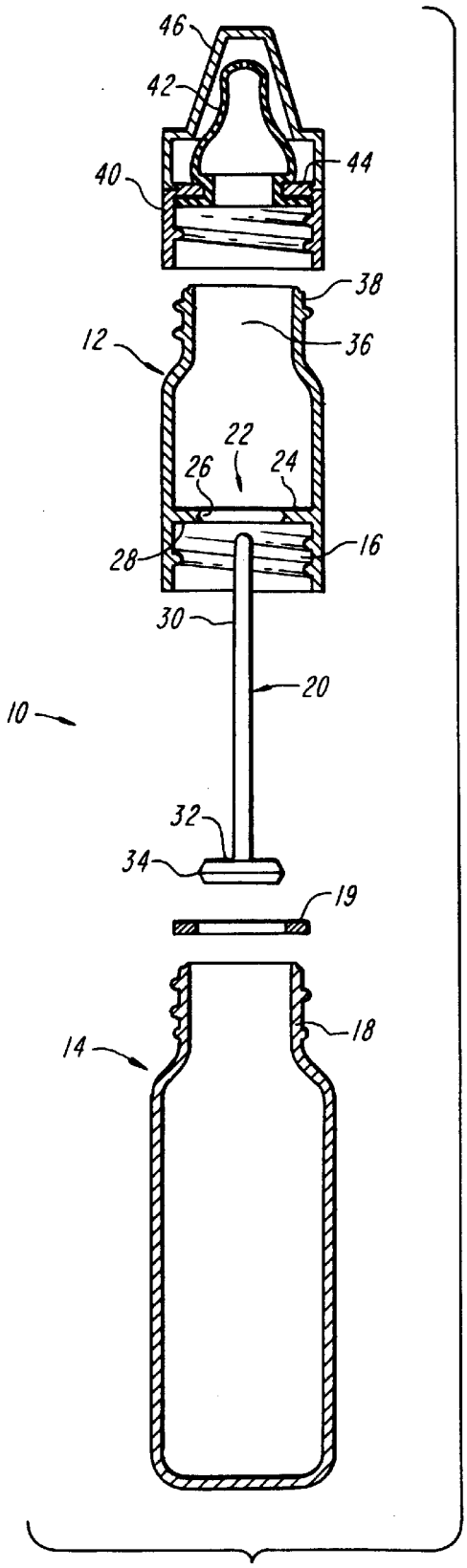
FIG. 1 is an exploded view in cross section of the Subject Invention illustrating the stemmed disk disposed between an upper bottle and a lower bottle.
Figure 2:
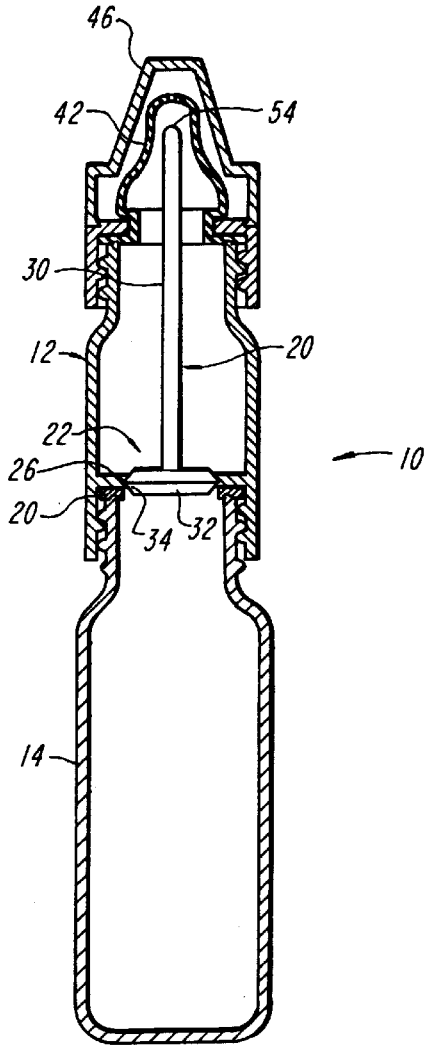
FIG. 2 is a crossectional view of the stemmed disk apparatus of FIG. 1 in assembled form, with the disk snapped into an annular slot in the aperture between the bottle.

Referring now to FIG. 1, in one embodiment of the Subject Invention, a baby bottle generally indicated by reference character 10 is in two parts, a primary container 12 and a secondary container 14, with the containers being joined via screw threads 16 on container 12 and 18 on container 14. In one embodiment, an O-ring 20 is utilized to seal the primary container to the secondary container when the two are threaded together as illustrated in FIG. 2.

A stemmed disk 20 is positioned within an aperture 22 defined by an annular lip 24 in container 12, with annular lip 22 having an annular slot 26 in an inwardly projecting wall 28, with the slot having a V-shaped cross section as illustrated in one embodiment. Stemmed disk 20 includes a shaft 30 and a disk-shaped member 32, which has a periphery 34 which has an inverted V-shaped cross section as illustrated such that when stemmed disk 20 is in place as illustrated in FIG. 2 in aperture 22, disk 32 has its periphery 34 in mating engagement with slotted periphery 26 such that the two are mated in a snap-fit arrangement.

Referring back to FIG. 1, an opening 36 in neck 38 of container 12 is adapted to receive a cap 40 screwed thereon, with a nipple 42 affixed to the cap at inwardly projecting flange 44. A protective cover 46 is snapped over nipple 42 as illustrated.

Figure 3:
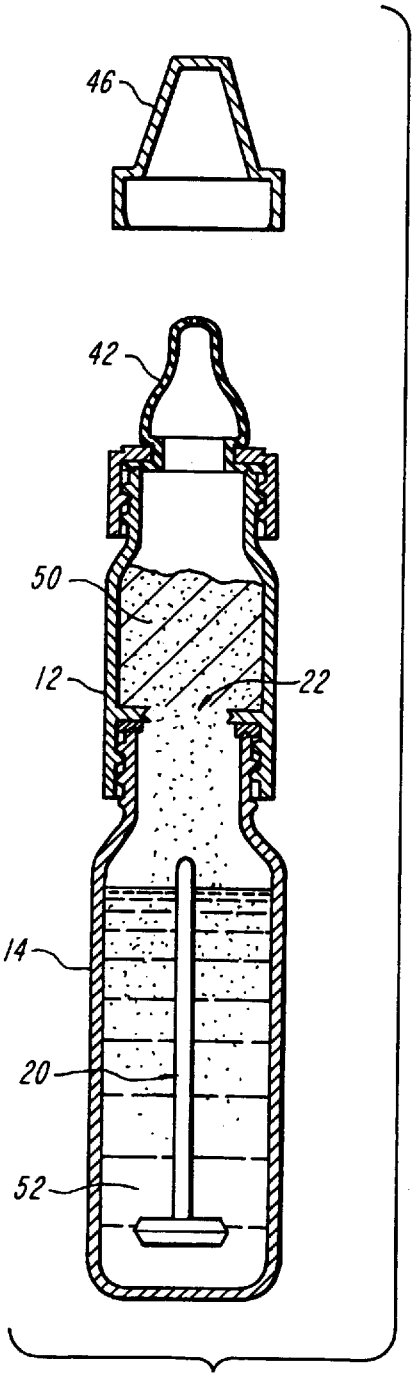
FIG. 3 is a diagrammatic illustration of the removal of the stemmed disk for the purpose of mixing the contents of the upper bottle, with the stemmed disk residing in the lower bottle after removal from the aperture.

In operation and referring now to FIG. 3, granular material 50 carried in primary container 12 is permitted to drop into container 14 carrying liquid when the stemmed disk 20 is depressed downwardly into secondary container 14 such that the stemmed disk drops into the container while at the same time permitting the granular mixture 50 to mix with liquid 52 in this container. This is accomplished by removal of protective cover 46 and downward depression of nipple 42 such that the finger used to depress the nipple depresses end 54 of the stemmed disk 20 to push the stemmed disk out of aperture 22 and into secondary container 14.

As such, the invention of FIGS. 1–3 show the invention embodied for use with a baby bottle to mix and feed powdered infant formula. What is illustrated is a plan for storing, mixing, and dispensing mixed powder and fluid in a baby bottle embodiment. Cap 40, nipple 42, and cap cover 46 of a conventional baby bottle are used together with primary container 12. Container 12 can be manufactured in any size to fit conventional bottles, collapsible liner type bottles, and any other type of bottle. In one embodiment, primary container 12 is cylindrical with male threaded top 38 to fit the conventional baby bottle cap. A female threaded bottom 16 fits the top of the conventional baby bottle 14, and a fitted collar 24 receives the stemmed disk shaped plug 32. Stemmed plug or disk 20 snaps into fitted collar 24 to form a water tight seal. The stem extends through the axis of the cylindrical primary container and out above the top of the primary container so that, when the cap and nipple are attached, it extends into, but not touching, the nipple. O-ring 19 is a gasket which is optionally installed between the primary container and the conventional baby bottle, forms a water tight seal.

Figure 4:
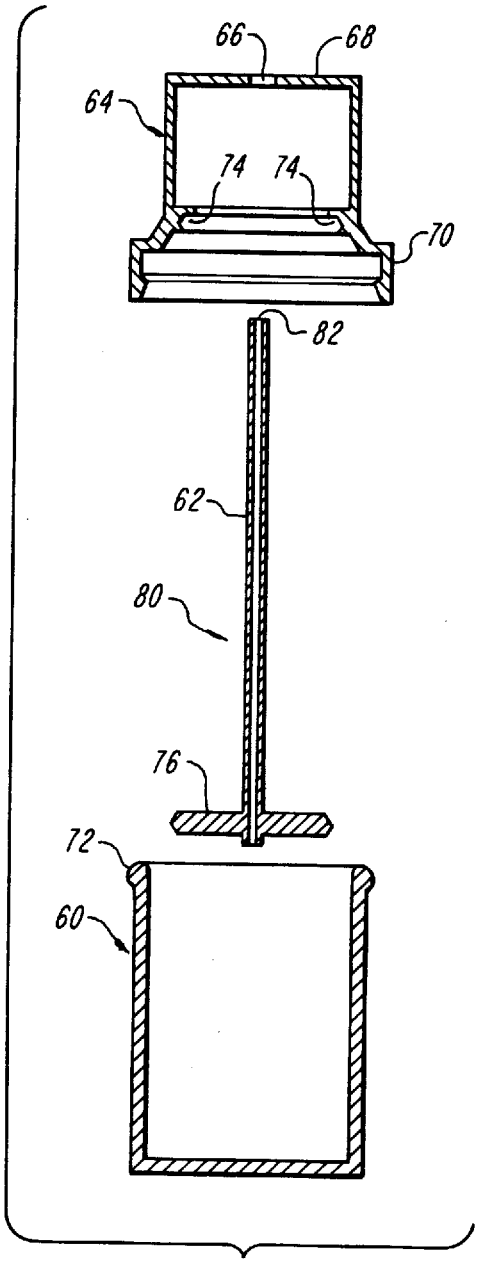
FIG. 4 is an exploded view in cross section of another embodiment of the Subject Invention illustrating a cup and straw arrangement.

With respect to an embodiment for storing, mixing, and dispensing with the container as a cup and straw, referring to FIG. 4 a cup 60 and straw 62 assembly is used for storing, mixing, and dispensing dietary supplements or other uses. The container can be manufactured in any size with its own cup or to fit conventional cups and glasses. Primary container 64 is cylindrical with a hole 66 in the center of a covered top 68. A fitted collar 70 is adapted to snap onto the rim 72 of cup 60, and a fitted collar 74 is provided to receive the stemmed plug or disk 76. The stemmed disk generally indicated at 80 snaps into the fitted collar to form a water tight seal.

As illustrated, stem 62 has a hollow bore 82 with open ends which can be used as a straw to drink the finished mixture, and is unit molded concentrically with disk 76. The axis of the stem runs at ninety degrees to the plane of the plug or disk. It extends through the axis of the cylindrical primary container and out through the top of the primary container. In one embodiment, the stem extends through the top of the primary container even when open and resting on the bottom of the cup, with cup 60 being the secondary container.

Figure 5:
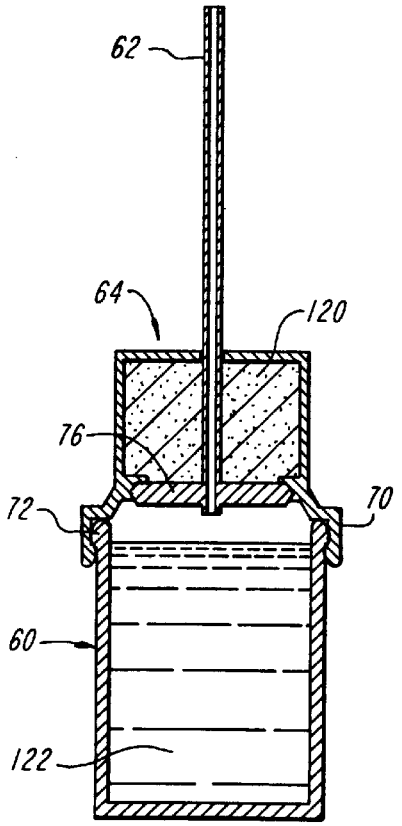
FIG. 5 is a crossectional view of the stemmed disk apparatus of FIG. 4 in assembled form, with the stemmed disk being snapped in an annular slot in the top container.
Figure 6:
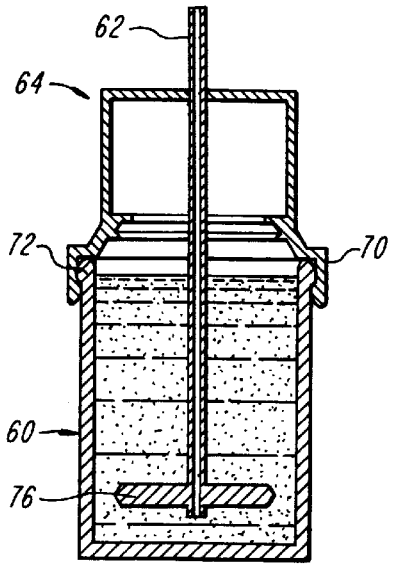
FIG. 6 is a diagrammatic illustration of the removal of the stemmed disk for purposes of mixing the contents of the upper container with the lower container.

FIGS. 5 and 6 show the assembled version and the actuation of the stemmed disk.

Figure 7:
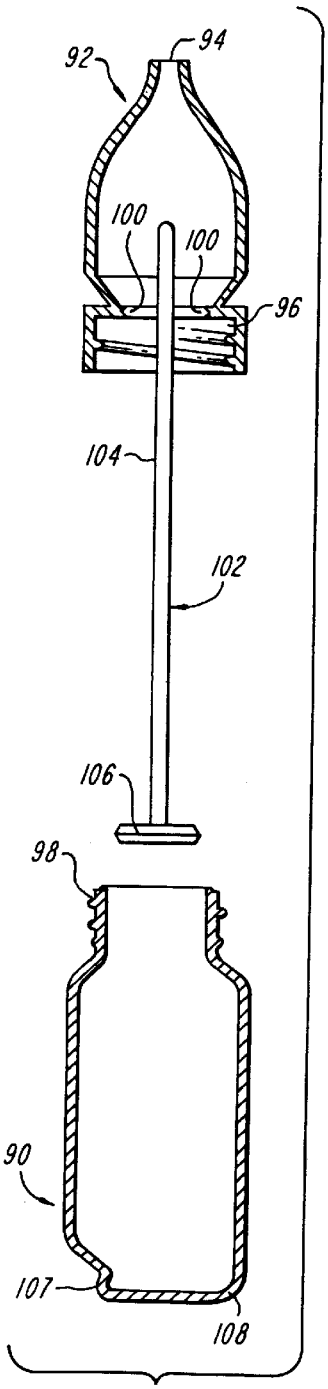
FIG. 7 is an exploded view in cross section of another embodiment of this subject invention illustrating the stem of the stemmed disk cooperating with a nozzle which fits on a container.
Figure 8:
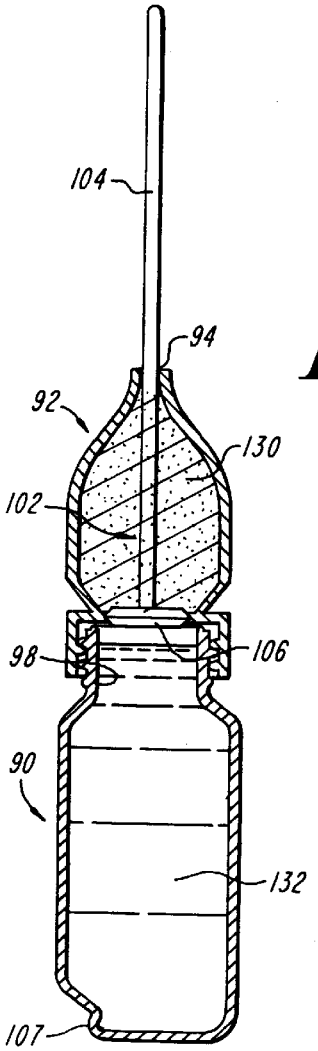
FIG. 8 is a crossectional view of the stemmed disk apparatus of FIG. 7 in assembled form with the disk snapped into an annular slot in the aperture between the containers; and, FIG. 9 is a diagrammatic view of the apparatus of FIG. 8 illustrating the removal of the stemmed disk to permit mixing.
Figure 9:
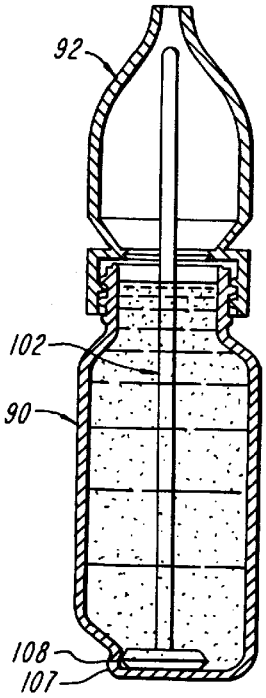

With respect to an embodiment for storing, mixing, and dispensing having a dispensing nozzle, and referring now to FIGS. 7–9, in FIG. 7 a bottle 90 and nozzle 92 are employed for storing, mixing, and dispensing paints or adhesives, and has other uses. The container can be manufactured in any size. As illustrated, the primary container includes nozzle 92 which, in one embodiment, is roughly conical with a hole 94 at the point of the cone. A threaded collar 96 is provided to screw onto the mouth 98 of bottle 90, and a fitted collar 100 is provided to receive the stemmed plug or disk 102. Nozzle 92 is flexible and can be compressed vertically. Note that the stemmed plug or disk 102 snaps into fitted collar 100 to form a water tight seal. Stem 104 is rigid and can be used to stir the finished mixture. The axis of the stem runs at ninety degrees to the plane of the disk 106. When assembled, it extends through the axis of the primary container and out through the top of the primary container. It will be appreciated that the stem does not extend through the top of the primary container when snapped into the bottom of the bottle. Note that bottle 90 is the secondary container. This bottle has molded retaining catches 107 in the bottom 108 having the cross section illustrated in FIG. 7. After mixing, the stemmed plug or disk can be pushed down by compressing the flexible nozzle and snapped into these retaining catches so that the stem is entirely inside the container and clear of the dispensing opening in the nozzle.

FIGS. 8 and 9 show the assembled version and operation respectively.

More specifically, the manufactured device has three basic components which are common to all embodiments. All of the parts of the embodiments can be manufactured by molding plastics. The basic parts are: a primary container to contain one of the mixing components, a stemmed plug or disk assembly to close and open the primary container, and a secondary container for the other mixing component during storage and the entire mixture during use. The primary container has a collar incorporated into the inside of the lower end into which the disk shaped portion of the stemmed plug or disk assembly snaps, closing the primary container. The primary container and stemmed plug assembly or disk assembly attaches to the top opening of the secondary container forming a cover and closure for the secondary container with the disk shaped portion of the stemmed plug forming a partition between the interior of the primary container and the interior of the container.

The manufactured device, in its embodiment as a baby bottle is shown in FIGS. 1–3. It is comprised of three parts; a primary container 12, a stemmed plug or disk 20, and a gasket 19. Each part is made of molded non-toxic plastic which can withstand repeated boilings. A standard baby bottle 14 is used as a secondary container and a standard baby bottle nipple 42 and cap 46 are attached to the primary container. The device of FIGS. 1–3 is shown for attachment to conventional bottles. It can also be manufactured in dimensions to fit disposable type bottles. Each part is made of molded non-toxic plastic which can withstand repeated boilings while retaining correct elastic properties so that interlocking parts snap together by hand and form water tight seals. The stem is made of material which will float in water or fluid 52 to keep it from blocking the outflow of fluid when the bottle is upside down during feeding. Stem 30 fits through the primary container and extends up into nipple 42. The flexible nipple allows the stem to be pushed down during mixing.

With the stemmed plug or disk assembly snapped in place, one part 50, usually powdered, of the mix formula is loaded into the primary container. The nipple/cap assembly 40 of a conventional baby bottle then screws in place with the nipple over the stem/disk assembly which prevents the contents of the primary container. Bottle 14 is filled with an amount of water appropriate to the measure of formula which was loaded into the primary container. Then the primary container screws onto the rim of the conventional baby bottle. The complete assembly can be stored at room temperature as long as dry powder remains usable, thus eliminating the difficulty of measuring, mixing, and/or warming of formula at feeding time. It can be kept near the baby's bed for instant use, stored at any orientation, and packed for travel. At the time for using the contents, the bottle is grasped with one hand with the thumb over the tip of the nipple. The stem is pressed down into the bottle without removing the nipple by depressing the flexible nipple with the thumb, releasing the contents of the top primary container and allowing it to mix with the contents of the bottle. The stem remains in the bottle and rattles to aid in the mixture of the contents when the bottle is shaken. Because it can be prepared with one hand, the assembly can be used while driving, holding the baby, etc.

Referring to FIGS. 4–6, this embodiment is comprised of three parts; a primary container 64, a stemmed plug or disk and straw assembly 80, and a cup secondary container 60. Each part is made of molded non-toxic plastic which can withstand repeated boilings with the correct elastic properties so that interlocking parts snap together functionally. Stem 62 is a tube which serves as a straw for drinking the mixture from the cup. The straw fits through hole 66 in the primary container with enough clearance to allow it to slide easily and to allow the passage of air, just barely preventing the formation of a vacuum when the stem is pushed down and during mixing. With the primary container inverted and the straw inserted and tilted to one side, but before the disk 76 is snapped in place, one part 120, usually powdered, of the mix formula is loaded into the primary container. Disk 76 then snaps in place in the base of the primary container forming a plug to contain the contents of the primary container. The other part of the mixture 122, usually liquid, is then loaded into the cup secondary container 60. Then the primary container snaps onto the rim of the cup. The completed assembly is reasonably spill proof and can be stored as long as the separate ingredients. At the time for using the contents, the straw is pressed down into the cup, releasing the contents of the top primary container and allowing them to mix with the contents of the cup. The straw can be manipulated to stir the two ingredients together. The resulting mixture can be drunk through the straw. A bed ridden patient can prepare and consume the contents unassisted and at their convenience. Spills are prevented during storage, mixing, drinking, and after drinking. The used container can be easily washed, sterilized, and reloaded.

Referring now to FIGS. 7–9, the embodiment as a bottle and nozzle is comprised of three parts; a nozzle primary container 92, a stemmed plug or disk assembly 102, and a flexible bottle secondary container 90. Each part is made of molded non-toxic plastic which can withstand repeated boilings. The stem of the stemmed plug or disk assembly fits through the hole in the nozzle primary container with enough clearance to allow it to slide easily and to allow the passage of air, preventing the formation of a vacuum when the stem is pushed down and during mixing. Disk 106 snaps in place in the base of the primary container forming a plug to contain the contents. The nozzle primary container 92 screws onto the bottle secondary container 90.

To use the container and nozzle embodiment, stem 104 is inserted through hole 94 in the nozzle primary container 92, but disk 106 is not snapped into place. Disk 106 is moved to one side to keep it out of the way and the resulting angle imparted to the stem causes it to form a seal with the hole in the primary container which will be effective to contain the first ingredient as it is loaded. The pre-measured first ingredient 130 is loaded into the nozzle primary container. Then assembly 102 is straightened and pushed through the hole until disk 106 snaps into place in the base of the primary container, forming a closed container. The bottle is fill ed with an amount of the second ingredient 132 appropriate to the measure of the first ingredient which was loaded into the primary container. The loaded stemmed plug and primary container assembly is then screwed onto the bottle secondary container. Prior to use, stem 104 is pressed down forcing disk 106 into bottle 90 which releases the first ingredient into the second ingredient. The contents can be mixed either by shaking or by grasping the exposed portion of the stem in the hand and using it to stir the mixture. When the mixing is complete, stem 104 is pressed completely into nozzle 92 and nozzle 92 is compressed until disk 106 snaps into the retaining shapes 107 molded into the bottom 108 of the bottle secondary container. The mixture can be extruded through the nozzle by squeezing the flexible bottle to compress it.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

I claim:

1. A baby bottle for the rapid mixing of a prestored substance with a fluid comprising:

primary and secondary containers in fluid communication, said containers having walls and mating orifices, with said primary container adapted to contain said prestored substance and with said secondary container adapted to contain said fluid;

means including an apertured nipple of flexible material at the top of said primary container and connecting with the interior of said primary container for dispensing said fluid after mixing, said nipple having a longitudinal extent so as to form a chamber having a vertically extending portion;

a stemmed disk having a stem with a distal end opposite the end with said disk, said disk adapted to seal the orifice associated with said primary container, said distal end of said stem being positioned proximate the tip of said nipple, with the stem of said stemmed disk projecting into said primary container along the longitudinal centerline thereof into the vertically extending portion of said nipple, the portion of said stem positioned within said vertically extending portion of said apertured nipple being spaced from said nipple to define a free annular portion therebetween, said disk having an outer periphery disposed in the orifice associated with said primary container, said containers being demountable to permit refilling and reuse as well as permitting reuse of said stemmed disk; and, means for sealing said disk in said orifice in a snap fit including an annular member at the orifice associated with said primary container, said annular member projecting inwardly from an interior wall of said primary container, whereby said disk is retained in sealed communication with said annular member in a snap fit, and whereby movement of said stem causes said disk to move with respect to said annular member, thus to become unsnapped to permit said mixing.

2. The system of claim 1 wherein each of said containers include matching screw threads adjacent the orifice thereof for the attachment of the containers together.

* * * * *